US006234769B1

(12) United States Patent
Sakai et al.

(10) Patent No.: US 6,234,769 B1
(45) Date of Patent: May 22, 2001

(54) HYBRID TYPE COMPRESSOR DRIVEN BY ENGINE AND ELECTRIC MOTOR

(75) Inventors: Takeshi Sakai, Chiryu; Masafumi Nakashima, Anjio; Takeshi Wakisaka, Nagoya; Hiroshi Kishita, Anjo; Mikio Matsuda, Okazaki; Hiroshi Ogawa, Nukata-gun; Hiroyasu Kato, Kariya, all of (JP)

(73) Assignees: Denso Corporation, Kariya; Nippon Soken, Inc., Nishio, both of (JP)

( * ) Notice: Subject to any disclaimer, the term of this patent is extended or adjusted under 35 U.S.C. 154(b) by 0 days.

(21) Appl. No.: 09/111,762

(22) Filed: Jul. 8, 1998

(30) Foreign Application Priority Data

| | | |
|---|---|---|
| Jul. 9, 1997 | (JP) | 9-184156 |
| Jul. 17, 1997 | (JP) | 9-192921 |
| Jul. 24, 1997 | (JP) | 9-198828 |
| Jan. 20, 1998 | (JP) | 10-009043 |

(51) Int. Cl.[7] ..... F04B 17/00
(52) U.S. Cl. ..... 417/374; 417/410.5; 62/323.3
(58) Field of Search ..... 417/374, 410.5, 417/319, 16; 62/323.3, 236

(56) References Cited

U.S. PATENT DOCUMENTS

| | | | | |
|---|---|---|---|---|
| 2,741,186 | | 4/1956 | Nallinger . | |
| 3,721,509 | * | 3/1973 | Kitrilakis | 417/374 X |
| 3,789,618 | * | 2/1974 | Feliz | 62/236 X |
| 4,293,281 | * | 10/1981 | Lamoreaux | 417/374 X |
| 4,947,657 | * | 8/1990 | Kalmbach | 62/236 |
| 4,998,864 | * | 3/1991 | Muir | 417/410 |
| 5,123,257 | * | 6/1992 | Anderson et al. | 62/236 |

FOREIGN PATENT DOCUMENTS

| | | | |
|---|---|---|---|
| 3608117A1 | | 3/1986 | (DE) . |
| 4137525A1 | | 11/1991 | (DE) . |
| 4137535A1 | | 11/1991 | (DE) . |
| 357159976 | * | 10/1982 | (JP) . |
| 4-164169 | | 6/1992 | (JP) . |
| 6-87678 | | 12/1994 | (JP) . |

* cited by examiner

*Primary Examiner*—Corrine McDermott
*Assistant Examiner*—Chen-Wen Jiang
(74) *Attorney, Agent, or Firm*—Pillsbury Winthrop LLP

(57) ABSTRACT

In a hybrid type compressor, a one-way clutch is provided between a magnet rotor and a rotor shaft for allowing rotational driving force generated by an electric motor unit to be transmitted only from a rotor to a shaft. Thus, the rotational driving force generated by a vehicle engine is not transmitted from the rotor shaft to the magnet rotor. That is, an inertia moment of a rotational system with respect to a vehicle engine is made small, thereby reducing the impact vibration when the clutch mechanism engages.

2 Claims, 13 Drawing Sheets

HYBRID TYPE COMPRESSOR DRIVEN BY ENGINE AND ELECTRIC MOTOR

CROSS REFERENCE TO RELATED APPLICATION

This application is based on and incorporates herein by reference Japanese Patent Application Nos. Hei. 9-184156 filed on Jul. 9, 1997, Hei. 9-192921 filed on Jul. 17, 1997, Hei. 9-198828 filed on Jul. 24, 1997, and Hei. 10-9043 filed on Jan. 20, 1998.

BACKGROUND OF THE INVENTION

1. Field of the Invention

The present invention relates to a hybrid type compressor which is driven by different driving sources such as an engine and an electric motor.

2. Description of Related Art

JP-U-6-87678 discloses a hybrid type compressor for vehicle air conditioning apparatus, in which the compression mechanism thereof is driven by an electric motor when an engine stops, and is driven by the engine when the engine operates.

In the hybrid type compressor disclosed in the above reference, because a swash plate constructing the compression mechanism is connected to the motor shaft of the electric motor, the rotor of the electric motor rotates even when the compression mechanism is driven by the engine.

As a result, the inertia moment of a rotating system including the swash plate and the rotor becomes large, and an impact vibration caused by engaging an electromagnetic clutch therewith becomes large, thereby making a passenger feel uncomfortably.

JP-A-4-164169 discloses a hybrid type compressor in which the rotational driving force of an engine is transmitted to the compression mechanism thereof through an electromagnetic clutch. In this hybrid type compressor, a discharged refrigerant amount is adjusted by ON-OFF controlling the electromagnetic clutch when the compression mechanism is driven by the engine, while it is adjusted by controlling a current amount supplied to an electric motor when the compression mechanism is driven by the electric motor.

Recently, the electromagnetic clutch is replaced by a variable capacity mechanism to change the discharged refrigerant amount for eliminating the impact caused by engaging the electromagnetic clutch therewith.

However, adding the variable capacity mechanism to the hybrid type compressor results in that the total cost of manufacturing the same increases.

Further, the performance of a refrigeration cycle mainly depends on the product of the volume of the compression chamber in the compression mechanism and the rotational speed thereof. Therefore, the volume of the compression chamber needs to be set in accordance with the demanded performance of the refrigeration cycle and the rotational speed of the driving source to drive the compression mechanism.

Accordingly, in the compression mechanism to attain the demanded refrigeration cycle performance when the volume of the compression chamber is enlarged and the rotational speed of the compression mechanism is lowed, a driving torque to drive the compression mechanism becomes large, thereby making the size of the electric motor unit large.

As described above, when the compression mechanism is driven by different driving sources, it is difficult to harmonize the characteristics of the driving sources and the compression mechanism with each other.

SUMMARY OF THE INVENTION

An object of the present invention is to provide a hybrid type compressor in which an impact vibration caused by engagement of a clutch mechanism is reduced.

According to a first aspect of the present invention, a one-way clutch is provided and allows rotational driving force generated by an electric motor unit to be transmitted only from a rotor to a shaft.

Thus, the rotational driving force is not transmitted from the shaft to the rotor. That is, an inertia moment of a rotational system with respect to a vehicle engine is made small, thereby reducing the impact vibration caused by engagement of the clutch mechanism. As a result, the driving system is less likely to be damaged, and the feeling of a passenger is improved.

According to a second aspect of the present invention, a clutch mechanism gains a press-force for pressing clutch plates from a fluid pressure discharged from the compression mechanism, thus the clutch mechanism can engage calmly in comparison with the electromagnetic clutch. As a result, the impact vibration caused by engagement of the clutch mechanism can be made much small.

According to a third aspect of the present invention, because a second one-way clutch is provided and transmits a rotational driving force only from an external driving source to the shaft, an electromagnetic clutch is not needed. Thus, the construction of the hybrid type compressor can be simplified, thereby reducing the total cost of manufacturing the hybrid type compressor.

According to a fourth aspect of the present invention, a speed changing mechanism for speed-decreasing the rotation generated by an electric motor unit and/or speed-increasing the rotation generated by an external driving source.

Thus, the characteristics of the driving sources and the compression mechanism are harmonized with each other.

BRIEF DESCRIPTION OF THE DRAWINGS

Additional objects and advantages of the present invention will be more readily apparent from the following detailed description of preferred embodiments thereof when taken together with the accompanying drawings in which.

Figure 1:
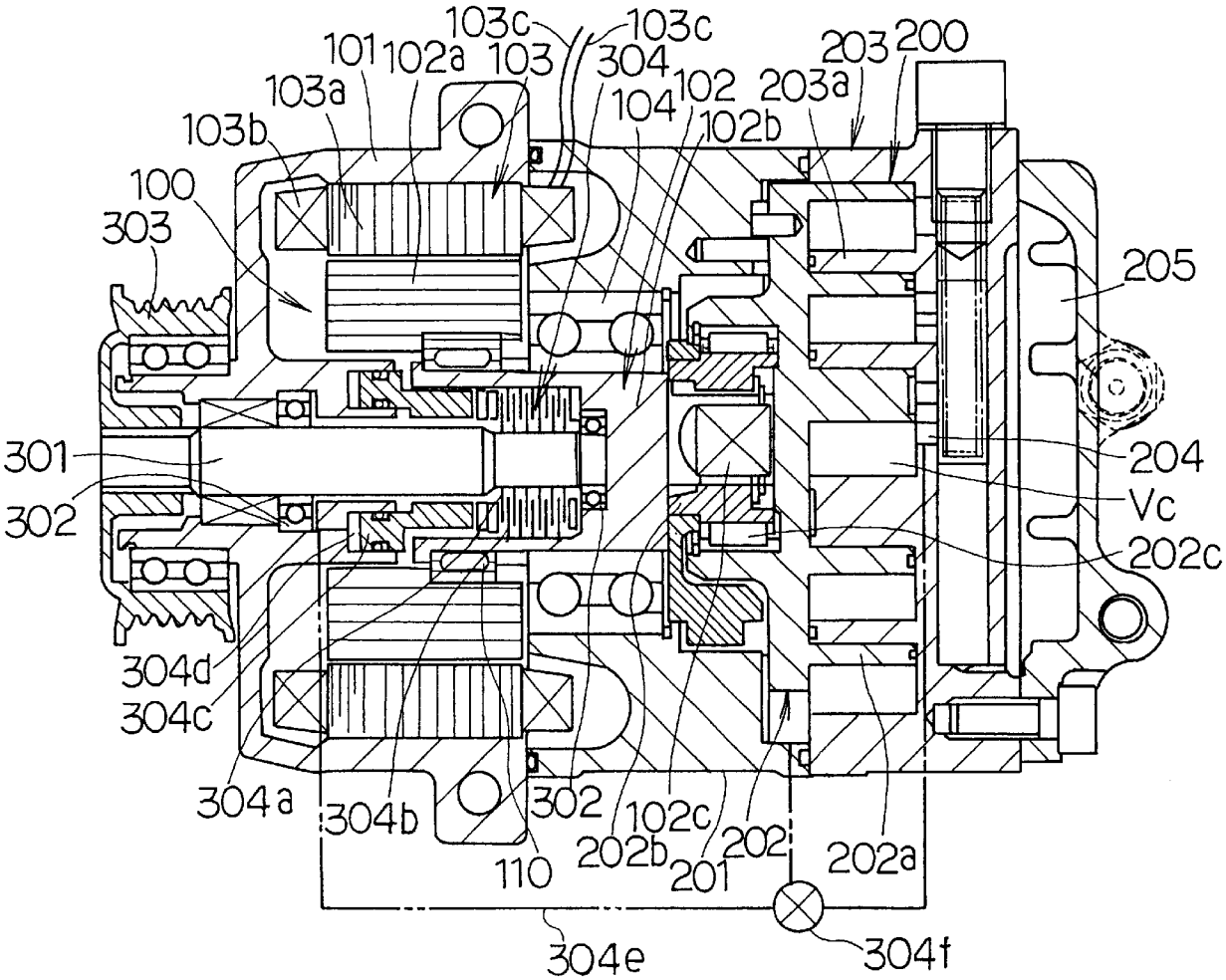
FIG. 1 is an entire cross sectional view showing a hybrid type compressor according to a first embodiment.

DETAILED DESCRIPTION OF PREFERRED EMBODIMENTS (First Embodiment)

In a first embodiment, a hybrid type compressor (hereinafter referred as a compressor) is applied to a refrigeration cycle for a vehicle air conditioning system.

The compressor includes a first housing 101 functioning as a yoke of an electric motor unit 100. A magnet rotor unit 102 having a magnet rotor 102*a* and a rotor shaft 102*b*, and a stator unit 103 having a stator core 103*a* and a stator coil 103*b* are provided in the first housing 101. The first housing 101, the magnet rotor unit 102, and the stator unit 103 form the electric motor unit 100. The electric motor unit 100 drives a movable scroll member of the compressor.

A lead wire 103*c* is connected to the stator coil 103*b* for supplying an electric energy to the stator coil 103*b* fixed to the first housing 101, and is connected to a control unit 400 described hereinafter. A bearing 104 is provided in a second housing 201 for supporting the rotor shaft 102*b* rotatably with respect to the stator unit 103.

Figure 2A:
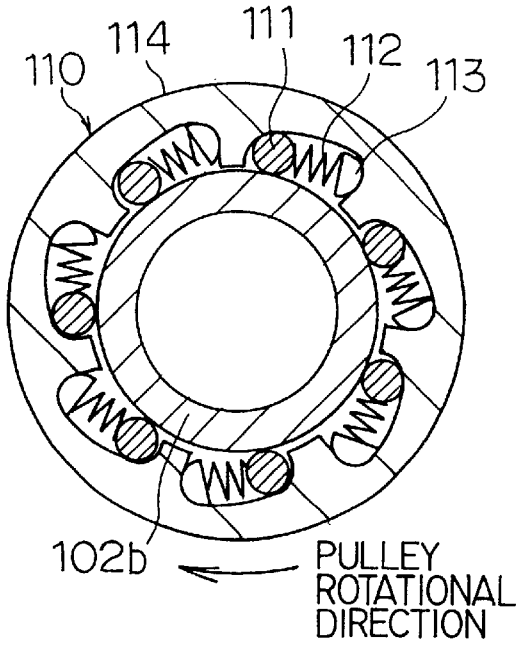
FIGS. 2A and 2B are schematic views showing a one-way clutch.
Figure 2B:
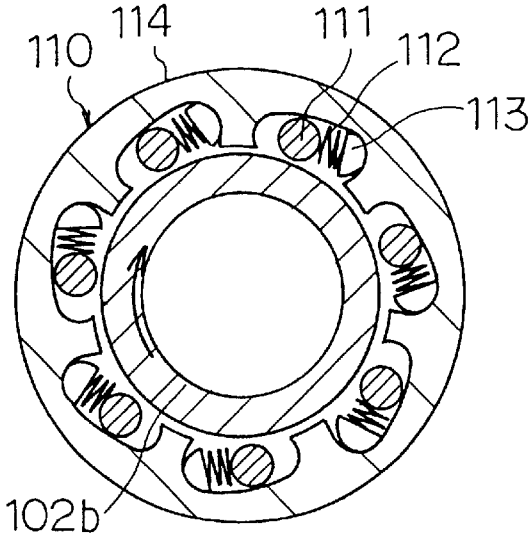

A one-way clutch 110 is provided between the magnet rotor 102*a* and the rotor shaft 102*b*. The one-way clutch 110 transmits a rotational force from the magnet rotor 102*a* to the rotor shaft 102*b* only. The one-way clutch 110 is, as well known, constructed by plural cylindrical rollers 111, plural springs 112, and a holder 113 supporting the rollers 111 and the springs 112, as shown in FIGS. 2A, 2B.

A scroll type compression mechanism 200 is provided at the rear end side (right side) of the rotor shaft 102*b*. The scroll type compression mechanism 200 includes the movable scroll member 202 orbiting around the rotational axis of the rotor shaft 102*b* to compress the refrigerant, and a fixed scroll member 203 fixed to the second housing 201.

Each scroll member 202, 203 has a spiral tooth 202*a*, 203*a*, and these teeth 202*a*, 203*a* form compression chambers Vc, where the refrigerant is suctioned and compressed, by engaging with each other.

The movable scroll member 202 are connected to the magnet rotor unit 102 (rotor shaft 102*b*) at a crank portion 102*c* formed at the rear end of the rotor shaft 102*b* through a cylindrical bush 202*b* and a bearing 202*c*.

A discharge port 204 is formed at the center of the end plate of the fixed scroll member 203 for discharging the compressed refrigerant from the compression chambers Vc to a discharge chamber 205. The discharged refrigerant having a high pressure is further discharged out of the compressor through a discharge outlet (not illustrated) of the compressor.

A pulley shaft 301 is provided in the first housing 101 to be coaxial to the rotor shaft 102*b*, and is rotatably supported by a bearing 302.

A pulley 303 is fixed to the front end side (opposite side to the compression mechanism 200) of the pulley shaft 301 outside the first housing 101. The pulley 303 transmits a rotational driving force from a vehicle engine (not illustrated) as an external driving source to the pulley shaft 301.

A clutch mechanism 304 is provided at the rear end side (the compression mechanism 200 side) of the pulley shaft 301 within the magnet rotor unit 102. The clutch mechanism 304 transmits the rotational driving force (rotational force) intermittently from the pulley shaft 301 to the rotor shaft 102*b* (movable scroll member 202).

First clutch plates 304*a* are provided on the pulley shaft 301 and rotate with the pulley shaft 301, and second clutch plates 304*b* are connected to the rotor shaft 102*b* and rotate by coupling with the first clutch plates 304*a*. A pressing piston 304*c* is provided at the front side of these clutch plates 304*a*, 304*b* and presses these clutch plates 304*a*, 304*b* to generate friction force therebetween.

A pressure control chamber 304*d* is formed in a cylinder in which the pressing piston 304*c* is installed, and controls a pressure to be supplied to the pressing piston 304*c*. Either one of the suction side pressure and the discharge side pressure of the compression mechanism 200 is selectively introduced into the pressure control chamber 304*d* by the action of an electromagnetic three-way valve 304*f*. The electromagnetic three-way valve 304*f* is provided in a pressure introducing passage 304*e* and allows one of the suction side pressure and the discharge side pressure to be introduced into the pressure control chamber 304*d*. The electromagnetic three-way valve 304*f* is controlled by a control unit.

Next, an operation of the compressor will be described.

1. When the compression mechanism 200 is driven by the vehicle engine:

When the air conditioning apparatus starts, the control unit controls the electromagnetic three-way valve 304*f* so that the pressure control chamber 304*d* communicates with the discharge side of the compression mechanism 200, and simultaneously supplies a predetermined electric voltage to the stator unit 103 (stator coil 103*a*) in a predetermined period. Then the magnet rotor unit 102 rotates and the discharge pressure of the compression mechanism 200 increases.

Thereby, the high discharge pressure is introduced into the control chamber 304*d*, and the clutch plates 304*a*, 304*b* are pressed to engage with each other, i.e., the clutch mechanism 304 is engaged. The rotational driving force from the vehicle engine is transmitted to the movable scroll member 202 through a belt (not illustrated), the pulley 303 and the pulley shaft 301, thereby driving the compression mechanism 200.

Here, because the one-way clutch 110 is provided between the magnet rotor 102*a* and the rotor shaft 102*b*, the rotational driving force is not transmitted from the rotor shaft 102*b* to the magnet rotor 102*a*.

2. When the compression mechanism 200 is driven by the electric motor unit 100:

When the air conditioning apparatus starts, the control unit controls the electromagnetic three-way valve 304*f* so that the pressure control chamber 304*d* communicates with the suction side of the compression mechanism 200, and simultaneously supplies a predetermined electric voltage to the stator unit 103 (stator coil 103*a*) in a predetermined period. Then the magnet 102 rotates, and the rotational driving force from the electric motor unit 100 is transmitted to the compression mechanism 200 through the one-way clutch 110 to drive the compression mechanism 200. At this time, because the low suction side pressure is introduced into the control chamber 304*d*, the clutch plates 304*a*, 304*b* are not pressed to engage with each other, i.e., the clutch mechanism 304 is not engaged. Thus, the rotational driving force from the vehicle engine is not transmitted to the rotor shaft 102*b*, and the compression mechanism 200.

According to the first embodiment, because the one-way clutch 110 is provided between the magnet rotor 102*a* and the rotor shaft 102*b*, the rotational force is not transmitted from the rotor shaft 102*b* to the magnet rotor 102*a* even when the clutch mechanism 304 is engaged.

Therefore, the inertia moment of a rotational system with respect to the vehicle engine is made small, thereby reducing the impact vibration when the clutch mechanism 304 engages. As a result, the driving system including the clutch mechanism 304, the rotor shaft 102*b* and the clutch shaft 301 is less likely to be damaged, and the feeling of a passenger is improved.

Further, because the clutch mechanism 304 is provided within the magnet rotor unit 102, the size of the compressor in the longitudinal direction of the rotor shaft 102*b* is made small in comparison with a compressor in which the clutch mechanism 304 is provided outside the magnet rotor unit 102.

The clutch mechanism 304 gains the press-force for pressing the clutch plates 304*a*, 304*b* from the refrigerant pressure discharged from the compression mechanism 200, thus the clutch mechanism can engage calmly in comparison with an electromagnetic clutch. As a result, the impact vibration caused by engagement the clutch mechanism 304 can be made much small.

Here, the efficiency of the compression mechanism 200, which is defined as (kinetic energy of the fluid discharged from the compression mechanism 200)/(mechanical energy supplied to the compression chamber 200), changes in accordance with the rotational speed thereof, the density of the fluid (refrigerant) suctioned and compressed, the volume of the compression chamber Vc, and the like. Therefore, the volume of the compression chamber Vc and rotational speed of the compression mechanism 200 need to be set appropriately in accordance with a demanded compression load (kinetic energy of the discharged fluid) for operating the compression mechanism 200 efficiently.

Generally, in the refrigeration cycle for a vehicle, because the compression mechanism 200 is driven by a vehicle engine only, the rotational speed of the compression mechanism 200 is controlled by adjusting the diameter of the pulley 303. In a compressor described in the above reference, the setting of the pulley diameter is much restricted because both pulley and electromagnetic clutch are disposed within the housing.

However, in the present embodiment, because the pulley 303 is disposed outside the first housing 101 and the clutch mechanism 304 is disposed within the first housing 101, the pulley 303 does not interfere with the first housing 101. Thus, the diameter of the pulley 303 can be freely and appropriately set in comparison with the conventional compressor disclosed in the above-described reference. As a result, the compression mechanism can be operated more efficiently than the conventional compressor.

For example, in the present embodiment, the diameter of the pulley 303 is set smaller than the outer diameter of the magnet rotor unit 102 to drive the compression mechanism 200 with high rotational speed, thereby downsizing the compression mechanism 200 (compression chamber Vc) and the electric motor unit 100.

(Second Embodiment)

In the first embodiment, the clutch mechanism 304 is caused to engage by the discharge pressure of the compression mechanism 200, however, other clutch mechanism such as an electromagnetic clutch may be employed instead of the clutch mechanism 304 of the first embodiment.

Figure 3:
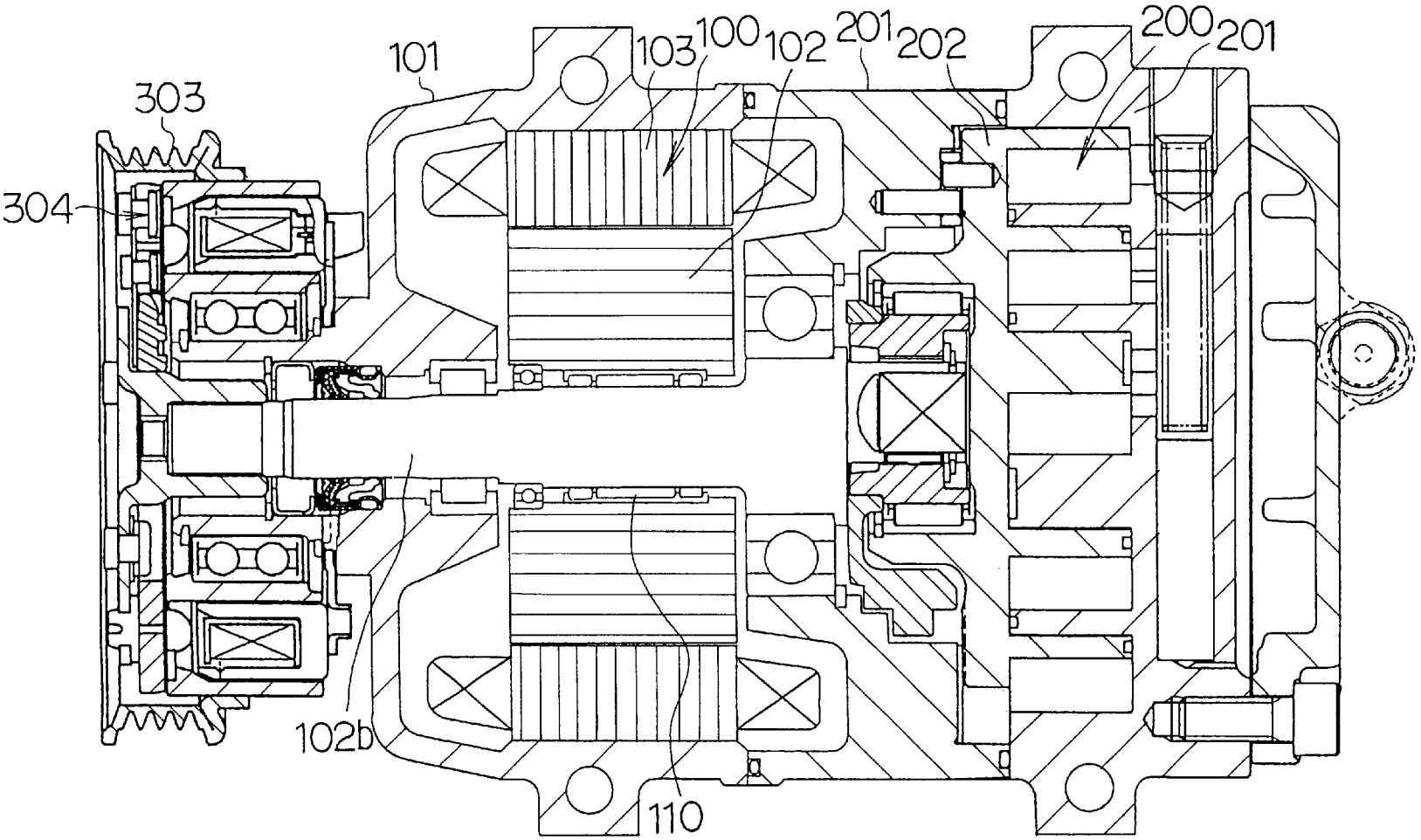
FIG. 3 is an entire cross sectional view showing a hybrid type compressor according to a second embodiment.

According to a second embodiment, as shown in FIG. 3, the rotor shaft 102*b* extends to the pulley 303, and the clutch mechanism 304 is provided outside the first housing 101. Here, an electromagnetic clutch is employed as the clutch mechanism 304.

In the above first and second embodiments, the scroll type compression mechanism is employed as the compression mechanism 200, however, other compression mechanism such as a rolling piston type or a vane type compression mechanisms may be employed.

The electric motor unit 100, the compression mechanism 200, and the clutch mechanism 304 are integrated together, however, the electric motor unit 102 may be separated from the compression mechanism 200, and both may be connected to each other through the clutch mechanism 304.

In the electric motor unit 100, the electric energy is supplied to the stator unit 103, however the electric energy may be supplied to the magnet rotor unit 102 instead.

The one-way clutch is not limited to a roller type one-way clutch, and a sprag type one-way clutch may be used.

Further, in the above first and second embodiments, the one-way clutch 110 is disposed between the magnet rotor 102*a* and the rotor shaft 102*b*, however, the one-way clutch 110 may be disposed at other positions to transmit the rotational driving force from the magnet rotor 102*a* to the rotor shaft 102*b*.

(Third Embodiment)

According to a third embodiment, a hybrid type compressor (hereinafter referred as a compressor) 500 is applied to an air conditioning system of a hybrid type vehicle driven by a combustion engine and an electric motor.

Figure 4:
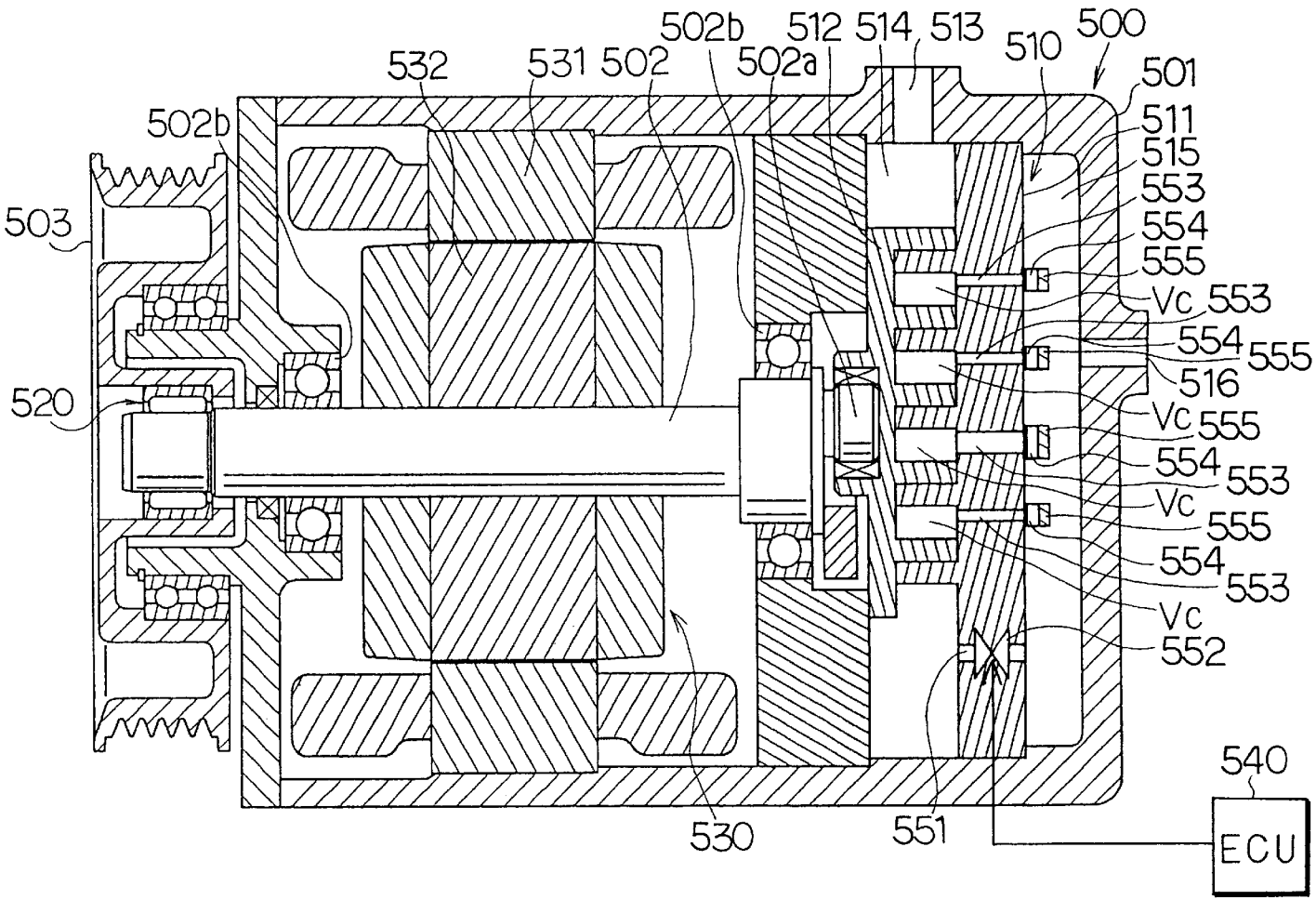
FIG. 4 is an entire cross sectional view showing a hybrid type compressor according to a third embodiment.

As shown in FIG. 4, the compressor 500 includes a housing 501 and a compression mechanism 510 provided in the housing 501 at the axial rear end of the compressor 500.

A well known scroll type compression mechanism is employed as the compression mechanism 510, and the scroll type compression mechanism includes a fixed scroll member 511 fixed to the housing 501, and a movable scroll member 512 orbiting with respect to the fixed scroll member 511.

The compressor 500 further includes a suction port 513, a suction chamber 514, a discharge chamber 515, and a discharge outlet 516. The suction port 513 is connected to the outlet side of an evaporator (not illustrated) of a refrigeration cycle. The discharge chamber 515 absorbs pulsation of the compressed refrigerant, and the discharge outlet 516 is connected to the inlet side of a condenser (not illustrated) of the refrigeration cycle.

A shaft 502 is rotatably supported in the housing 501 by a bearing 502*b*. The shaft 502 transmits a rotational driving force to the movable scroll member 512, and has a crank portion 502*a* at the rear side end thereof. The crank portion 502*a* is eccentric to the center axis of the shaft 502. The movable scroll member 512 is connected to the crank portion 502*a*, and is rotatable with respect to the crank portion 502*a*.

At the front end side of the shaft 502, a one-way clutch 520 is provided between a pulley 503 and the shaft 504. The one-way clutch 520 transmits a rotational driving force from the engine, through a V-belt and the pulley 503, to the shaft 502 by only one rotational direction. Here, the one-way clutch 520 may be disposed at other positions where the one-way clutch can transmit the rotational driving force from the pulley 503 to the shaft 502.

Figure 5A:
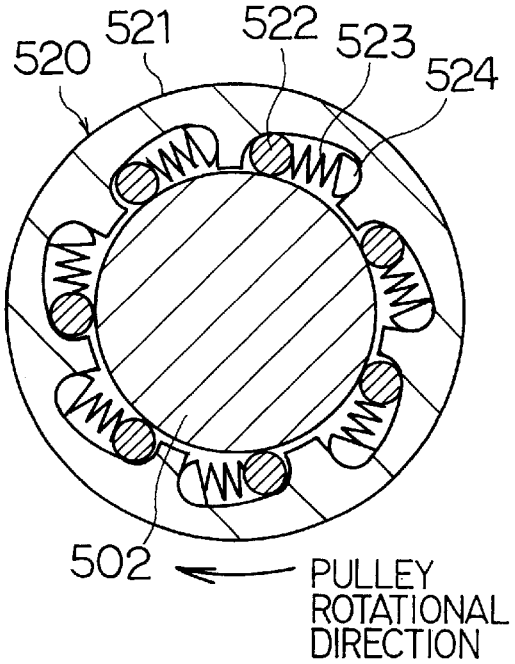
FIGS. 5A and 5B are schematic views showing a one-way clutch.
Figure 5B:
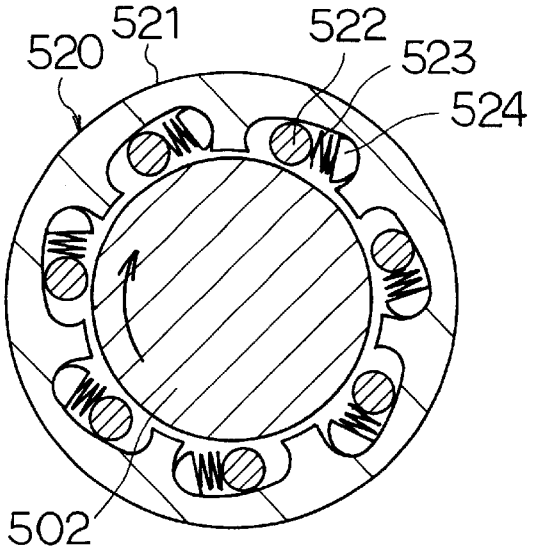

The one-way clutch 520 is, as shown in FIGS. 5A, 5B, a well known roller type one-way clutch including a holder 521, plural cylindrical rollers 522, plural springs 523, and plural seat metals 523.

The rotational direction of the rotational driving force transmitted by the one-way clutch 520 corresponds to the orbiting direction of the movable scroll member 512. Thus, when the pulley 503 rotates in the orbiting direction of the movables scroll member 512, the rotational driving force thereof is always transmitted to the shaft 502.

An electric motor unit 530 is provided between the pulley 503 and the compression mechanism 510. The electric motor unit 530 includes a stator 531 fixed to the housing 501, and a rotor 532 rotating inside of the stator 531. The shaft 502 is press fixed into the rotor 532 for rotating with the rotor 532. Here, in the present embodiment, an induction-motor is employed as the electric motor unit 530.

A first communication passage 551 is formed in the fixed scroll member 511 for making the suction chamber 514 communicate with the discharge chamber 515, and is opened/closed by an electromagnetic valve 552. The electromagnetic valve 552 is controlled by an electric control unit (ECU) 540 in accordance with the operational conditions of the engine and the air conditioning apparatus. The ECU 540 includes, as well known, a central processing unit (CPU), a random access memory (RAM), and a read only memory (ROM).

In the fixed scroll member 511, plural second communication passages 553 which make the discharge chamber 515 communicate with a compression chamber Vc formed by engaging the fixed scroll member 511 and the movable scroll member 512. Lead valves 554 are provided in each second communication passages 553 at the side of the discharge chamber 515, for preventing the refrigerant returning from the discharge chamber 515 into the compression chamber Vc. Each lead valve has a stopper 555 to limit the maximum opening degree thereof.

Next, an operation of the compressor 500 will be described.

1. When the compression mechanism 510 is driven by the vehicle engine while the engine (external driving source) operates:

When the air conditioning apparatus starts, the electromagnetic valve 552 closes the first communication passage 551. Then, the refrigerant pressure inside the discharge chamber 515 rises with the movable scroll member 511 rotating. The refrigerant is gradually compressed while moving from the outside to the inside of the compression mechanism, thus the refrigerant pressure in the inside compression chamber Vc is higher than that in the outside compression chamber Vc. At this time, the lead valves 554 close the second communication passages 553 which communicate with the compression chamber Vc the pressure inside which are lower than the pressure inside the discharge chamber 515. Therefore, the refrigerant is discharged from only the compression chamber Vc the pressure inside which rises higher than the pressure inside the discharge chamber 515.

2. When the compression mechanism 510 is caused to stop while the engine operates:

The electromagnetic valve 552 opens the first communication passage 551. Then, the suction chamber 514 communicates with the discharge chamber 515, and the pressure inside the discharge chamber 515 becomes the same pressure as inside the suction chamber 514. Thus, even when the refrigerant inside the compression chamber Vc is compressed and the pressure thereof rises higher than the suction pressure, the lead valves 554 always open the second communication passages 553.

Thus, the refrigerant introduced into the compression chamber Vc from the suction chamber 514 returns to the suction chamber 514 through the second communication passages 553, the discharge chamber 515 and the first communication passage 551. As a result, the refrigerant is not discharged from the compressor 500 and circulates inside the compressor 500. That is, the compressor 500 does not operate with respect to the refrigeration cycle.

As described above, in the present embodiment, a variable capacity mechanism 550 changing the amount of the discharged refrigerant is constructed by electromagnetic valve 552, the first and second communication passages 551, 553 and the lead valves 554.

3. When the compression mechanism 510 is driven by the electric motor unit 530:

The electromagnetic valve 552 closes the first communication passage 551, and electric current is supplied to the electric motor unit 530 (stator 531) to rotate the movable scroll member 511 (shaft 502).

In the present embodiment, because the rotational driving force is transmitted from the engine to the shaft 502 through the one-way clutch 520, an electromagnetic clutch is not needed. Thus, the construction of a hybrid type compressor can be simplified, thereby reducing the total cost of manufacturing the hybrid type compressor.

Further, a one-way clutch generally transmits a large rotational driving force for the size thereof, thereby downsizing the hybrid type compressor.

(Fourth Embodiment)

Figure 6:
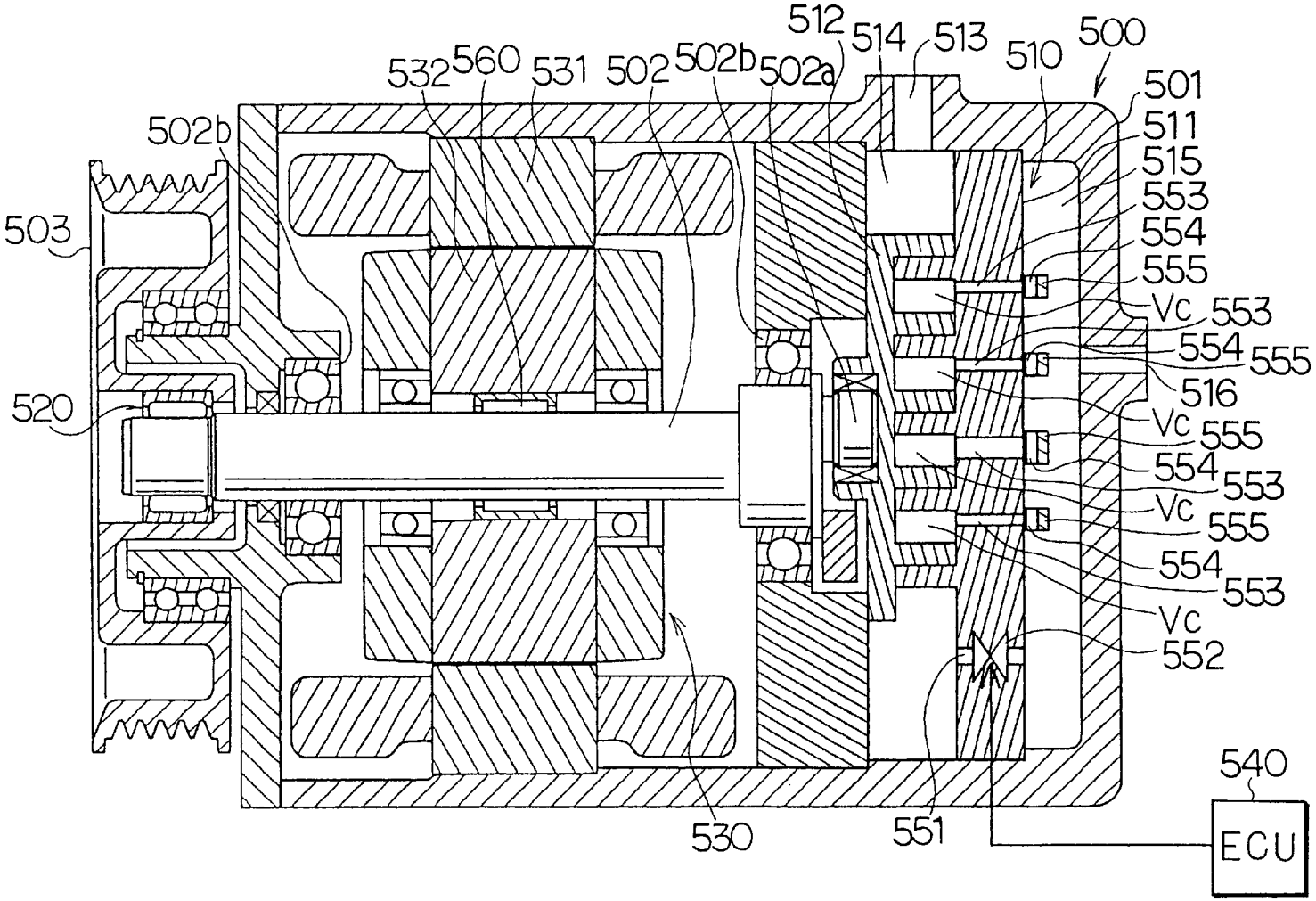
FIG. 6 is an entire cross sectional view showing a hybrid type compressor according to a fourth embodiment.

According to a fourth embodiment, as shown in FIG. 6, a one-way clutch 560 is disposed between the rotor 532 and the shaft 502. Here, the one-way clutch 520 may be disposed at other positions where the one-way clutch can transmit the rotational driving force from the rotor 532 to the shaft 502.

The rotational direction of the rotational driving force transmitted by the one-way clutch 560 corresponds to the orbiting direction of the movable scroll member 512. Thus, when the rotor 532 rotates in the orbiting direction of the movables scroll member 512, the shaft 502 always rotates.

Thus, when the compression mechanism 510 (movable scroll member 511) is driven by the vehicle engine, the rotor 532 does not rotate. Thereby, it is suppressed to waste the rotational driving force transmitted from the engine. As a result, the fuel consumption rate of the engine is improved.

Further, the stator 531 is less likely to generate heat caused by the electromotive force induced in the stator 531 when the rotor 532 rotates, thereby improving the durability of the electric motor unit 530.

Figure 7:
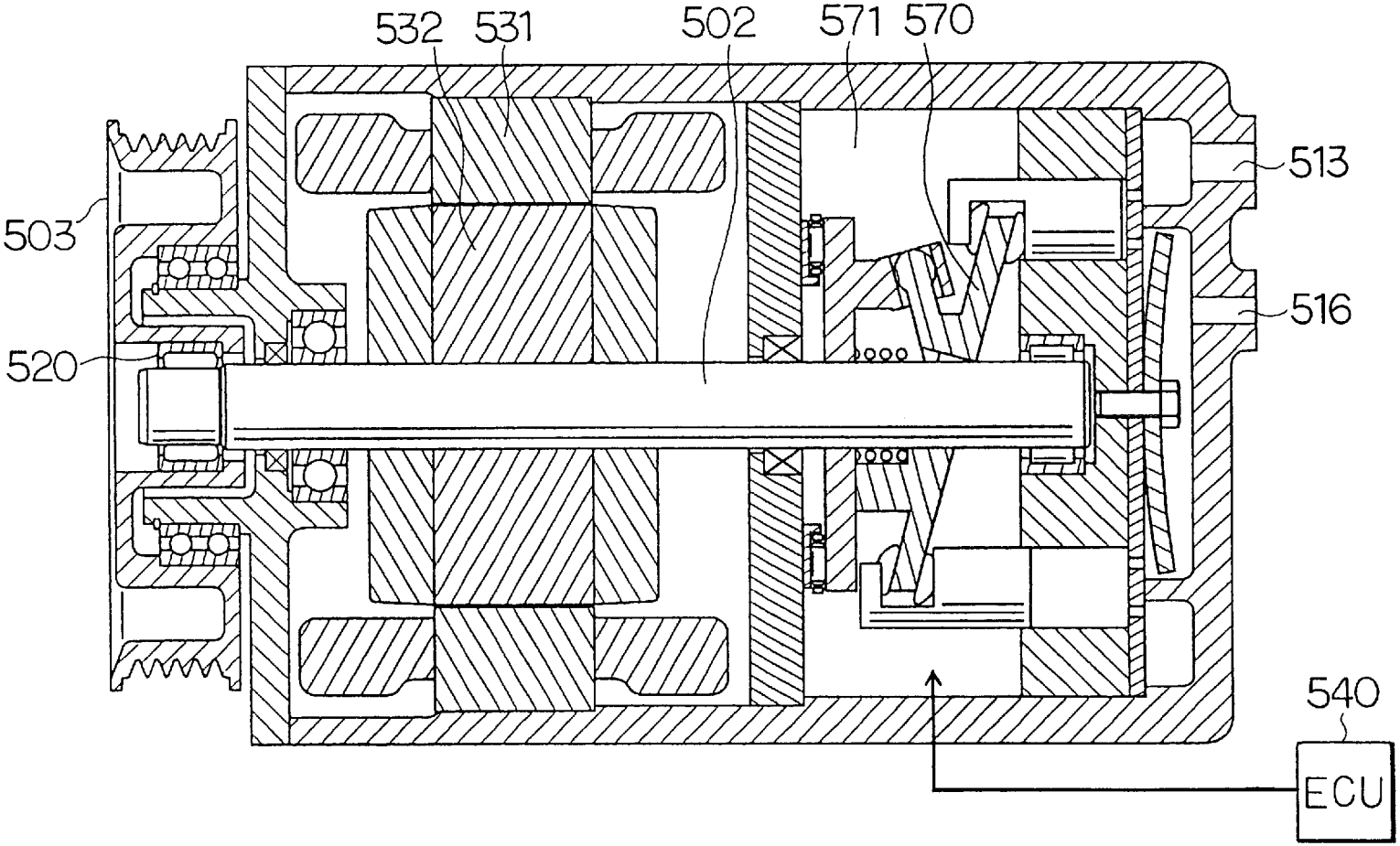
FIG. 7 is an entire cross sectional view showing a modified hybrid type compressor from the compressor of the fourth embodiment.

In the above third and forth embodiments, the scroll type compression mechanism is employed as the compression mechanism, however, other compression mechanisms such as a swash plate type compression mechanism shown in FIG. 7 may be employed instead. Here, it is preferable that the discharge capacity is adjusted by controlling the pressure inside a swash plate chamber 571 to change the angle of a swash plate 570.

In the above third and forth embodiments, the electromagnetic valve 551 is simply ON-OFF controlled in accordance with the operational conditions of the engine, however, the electromagnetic valve 551 may be duty controlled based on the pressure inside the evaporator, for adjusting the discharge volume of the compressor.

Further, the one-way clutches 520, 560 are not limited to the roller type one-way clutch, and a sprag type one-way clutch may be employed.

(Fifth Embodiment)

According to a fifth embodiment, a hybrid type compressor (hereinafter referred as a compressor) 600 is applied to an air conditioning system of a hybrid type vehicle driven by a combustion engine and an electric motor.

Figure 8:
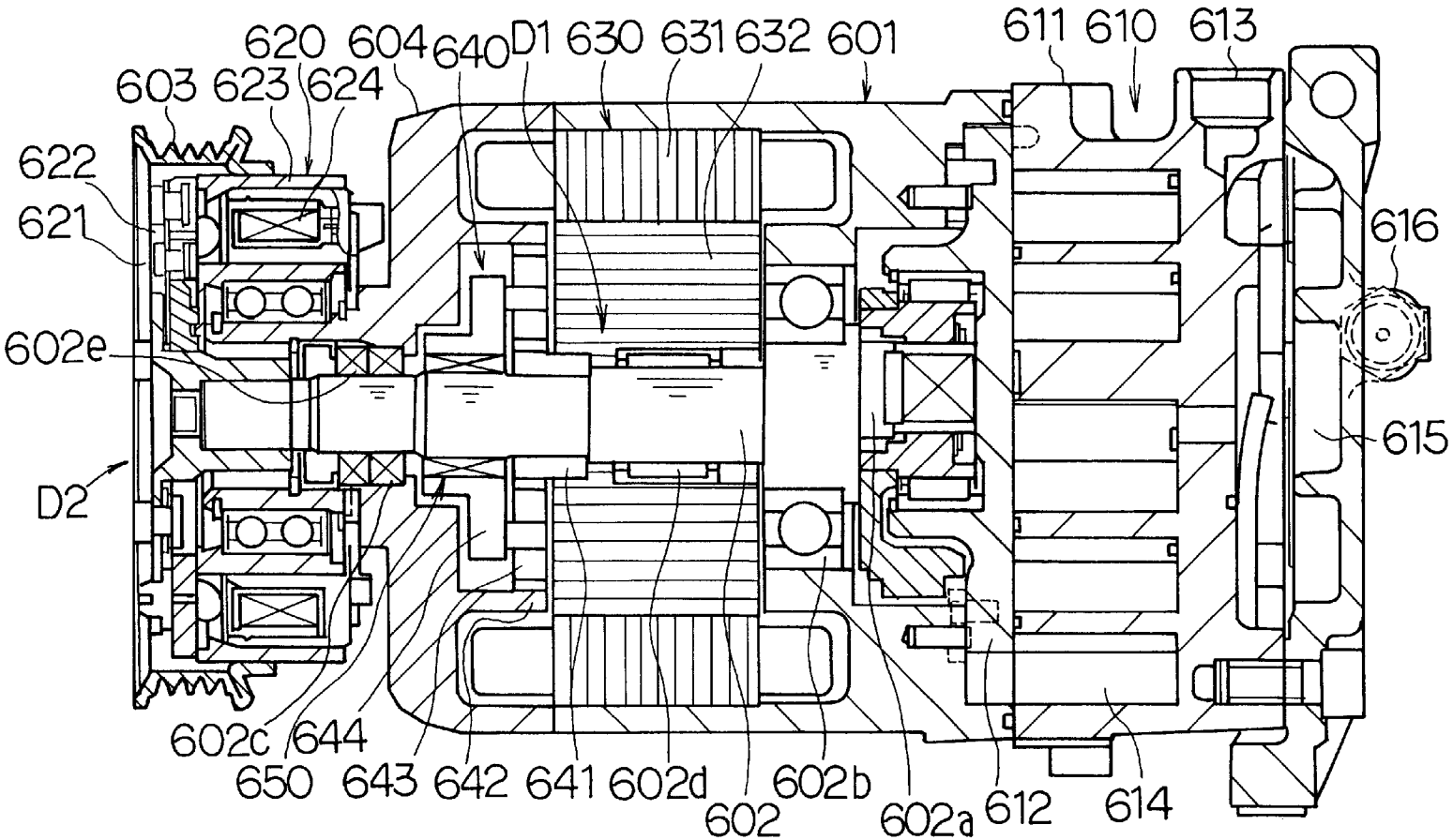
FIG. 8 is an entire cross sectional view showing a hybrid type compressor according to a fifth embodiment.

As shown in FIG. 8, the compressor 600 includes a compression mechanism 610 where refrigerant is suctioned and compressed. The compression mechanism 610 is provided at the rear side of the compressor 600.

A well known scroll type compression mechanism is employed as the compression mechanism 610. The scroll type compression mechanism includes a fixed scroll member 611 fixed to and integrated with a housing 601, and a movable scroll member 612 orbiting with respect to the fixed scroll member 611.

The compressor 600 further includes a discharge outlet 613, a suction chamber 614, a discharge chamber 615, and a relief valve 616.

The discharge outlet 613 is connected to the inlet side of a condenser (not illustrated) of a refrigeration cycle. The suction chamber 614 is connected to the outlet side of an evaporator (not illustrated) of the refrigeration cycle. The discharge chamber 615 absorbs pulsation of the compressed refrigerant.

A shaft 602 is rotatably supported in the housing 601 by bearings 602*b*, 602*c*. The shaft 602 transmits a rotational driving force to the movable scroll member 612, and has a crank portion 602*a* at the rear end thereof. The crank portion 602*a* is eccentric to the center axis of the shaft 602. The movable scroll member 612 is connected to the crank portion 602*a*, and is rotatable with respect to the shaft 602. The rotor 632 is rotatably supported by a bearing 602*d*. A front housing 604 and the shaft 602 are hermetically sealed by a lip seal 602*e*.

At the front end side of the shaft 602, a pulley 603 is provided outside the housing 601. A rotational driving force is transmitted from the engine (external driving source) to the pulley 603 through a V-belt (not illustrated), and the pulley 603 rotates. An electromagnetic clutch 620 (clutch mechanism) is provided radially inside of the pulley 603, for transmitting the rotational driving force supplied to the pulley 603 to the shaft 602 (compression mechanism 610) intermittently.

Here, the electromagnetic clutch 620 includes, as well known, a hub 621 slidably connected to the spline formed on the shaft 602, an armature 622 connected to the hub 621, a rotor 623 rotating with the pulley 603 and forming a part of magnetic circuit, and a stator coil 624.

An induction type electric motor unit 630 is provided between the pulley 603 and the compression mechanism 610. The electric motor unit 630 has a stator 631 fixed to the housing 601, and the rotor 632 rotating within the stator 631. The rotational driving force of the rotor 632 is transmitted to the shaft 602 through a speed change gear transmission 640, and a one-way clutch 650. Here, the speed change gear transmission 640 is constructed by a planetary gear mechanism, and the rotational speed is reduced by the speed change gear transmission 640.

Figure 9:
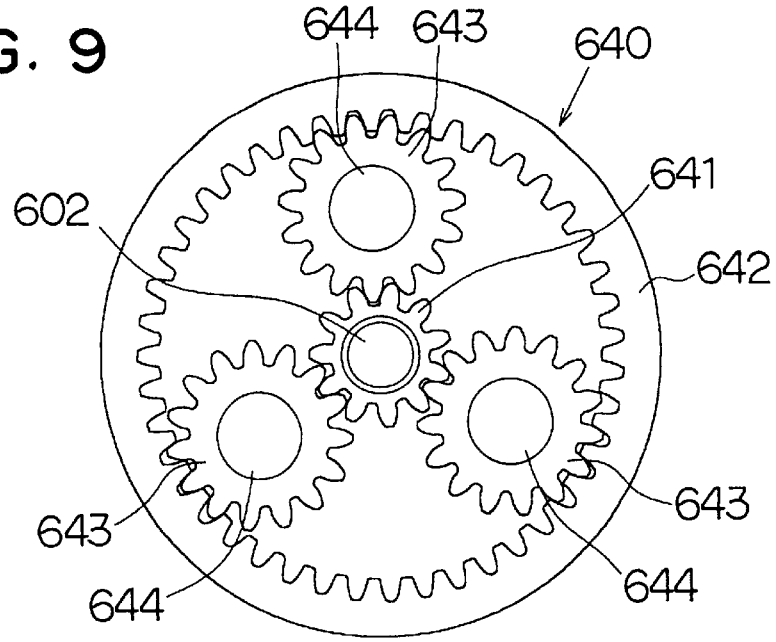
FIG. 9 is a plan view showing a speed change gear transmission according to the fifth embodiment.

The speed change gear transmission 640 includes, as shown in FIG. 9, a sun gear 641 and an internal gear 642. The sun gear 641 rotates along with the rotor 632 integrally and with respect to the shaft 602. The internal gear 642 is integrated with the front housing 604 (FIG. 8).

Further, the speed change gear transmission 640 includes three planetary gears 643, and holders 644. Each planetary gear 643 is engaged with the sun gear 641 and the internal gear 642. The holder 644 supports the planetary gear 643 rotatably, and transmits a rotational driving force of the planetary gear 643 orbiting around the sun gear 641 to the one-way clutch 650.

Figure 10A:
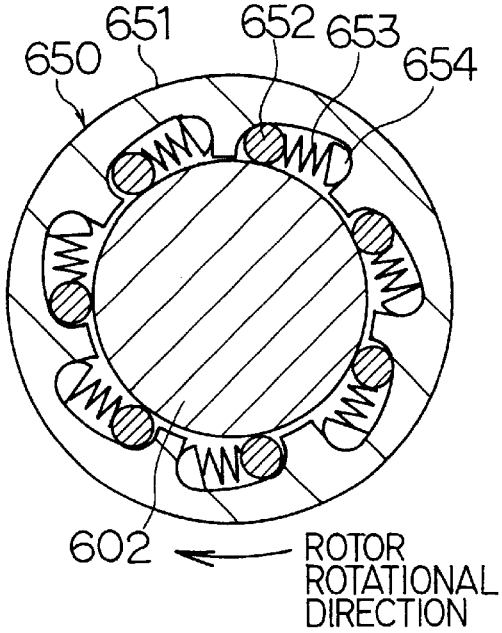
FIGS. 10A and 10B are schematic views showing a one-way clutch.
Figure 10B:
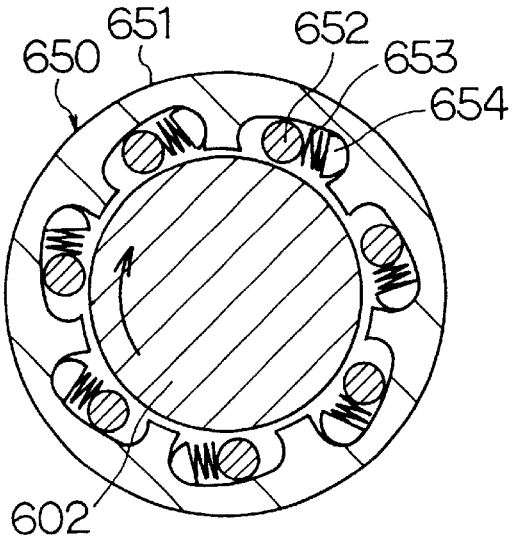

The one-way clutch 650 is, as shown in FIGS. 10A, 10B, a roller type one-way clutch including a holder 651, and plural cylindrical rollers 652, plural springs 653, and plural seat metals 654, which are disposed in the holder 651.

The rotational direction of the rotational driving force transmitted by the one-way clutch 650 corresponds to the orbiting direction of the movable scroll member 612. Thus, when the holder 644 (rotor 632) rotates in the orbiting direction of the movables scroll member 612, the rotational driving force thereof is always transmitted to the shaft 602.

Next, an operation of the compressor 600 will be described.

1. When the compression mechanism 610 is stopped:

The electric current is stopped being supplied to the electromagnetic clutch 620 and the electric motor unit 630.

Thus, the rotational driving force is not transmitted from the engine to the shaft 602, and the electric motor unit 630 does not operate. Thereby, the compression mechanism is stopped.

2. When the compression mechanism 610 is driven by the engine:

The electric current is supplied to the electromagnetic clutch 620, and is not supplied to the electric motor unit 630.

Then, the armature 622 engages with the rotor 623 to transmit the rotational driving force from the engine to the shaft 602, however, the electric motor 630 is not operate. Therefore, the compression mechanism 610 is driven by only the engine.

3. When the compression mechanism 610 is driven by the electric motor unit 630:

The electric current is supplied to the electric motor unit 630, and is not supplied to the electromagnetic clutch 620.

Thus, the electric motor unit 630 operates, however the rotational driving force from the engine is not transmitted to the shaft 602. Therefore, the compression mechanism 610 is driven by only the electric motor unit 630.

In the present fifth embodiment, the rotation of the electric motor unit 630 is speed-reduced by the speed change gear transmission 640, and is transmitted to the shaft 602 (compression mechanism 610). Thus, the rotational driving force generated by the electric motor unit 630 is increased and transmitted to the shaft 602.

Therefore, the compression mechanism 610 can be driven with the discharge volume Vc being large and the rotational speed being low, without making the electric motor unit 630 large.

Here, when the discharge volume Vc is set small and the rotational speed is set high for downsizing the electric motor unit 630, the diameter of the pulley 603 needs to be downsized for keeping the high rotational speed while the compression mechanism 610 is driven by the engine. That is, the electromagnetic clutch 620 also needs to be downsized. As a result, sufficient friction torque of the electromagnetic clutch 610, which transmits the rotational driving force, is not attained.

However, in the present embodiment, as described above, the compression mechanism 610 can be driven with the discharge volume Vc being large and the rotational speed being low. Thus, the pulley does not need to be downsized. As a result, sufficient friction torque of the electromagnetic clutch 620 is attained.

(Sixth Embodiment)

In the fifth embodiment, the speed change gear transmission 640 is provided at a first driving portion D1 which transmits the rotational driving force from the electric motor unit 630 to the movable scroll member 612, and the rotational speed is reduced by the speed change gear transmission 640.

Figure 11:
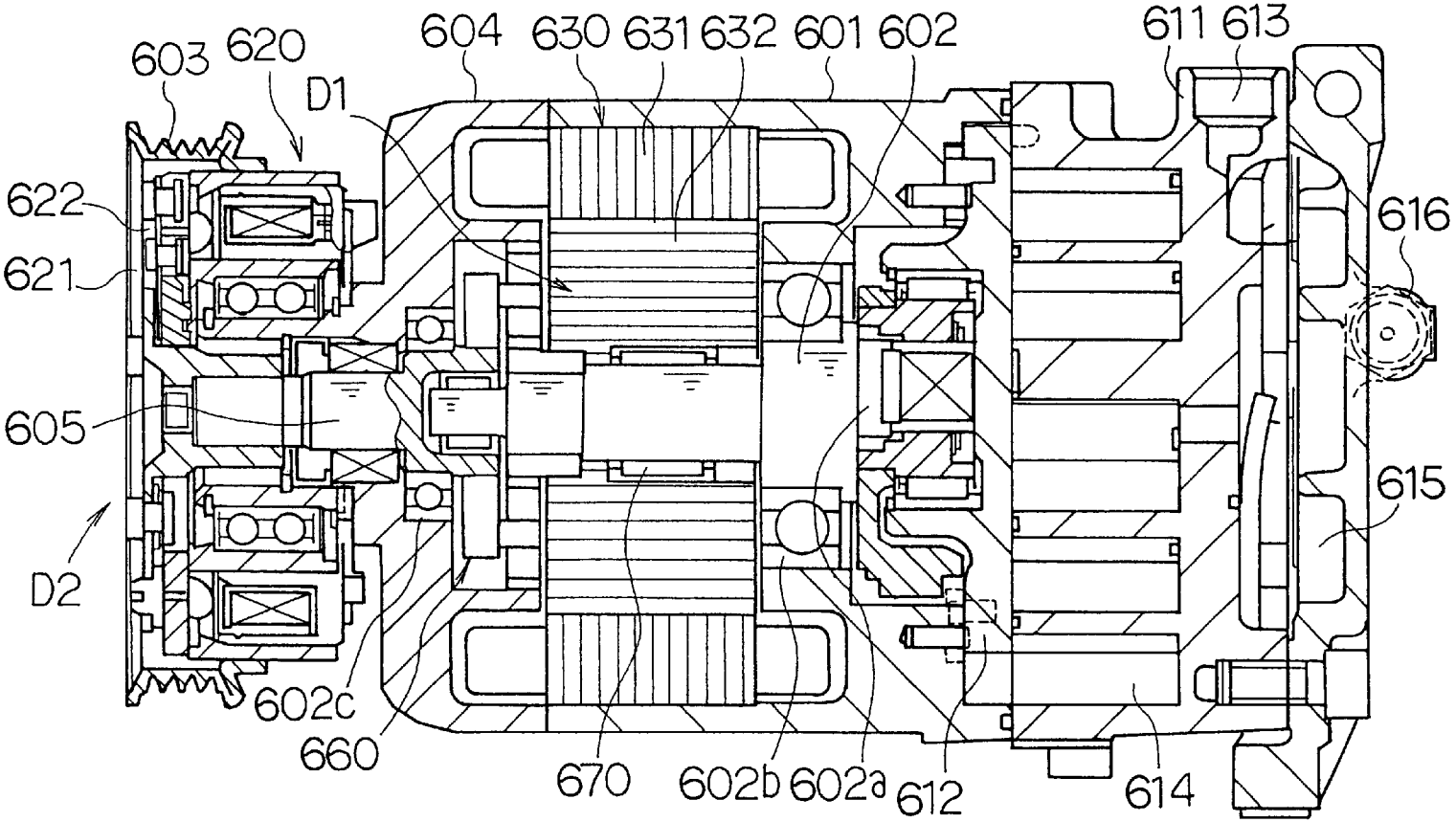
FIG. 11 is an entire cross sectional view showing a hybrid type compressor according to a sixth embodiment.

According to a sixth embodiment, as shown in FIG. 11, a speed change gear transmission 660 constructed by the planetary gear mechanism is provided at a second driving portion D2 which transmits the rotational driving force from the pulley 603 to the movable scroll member 612. The rotational speed of the pulley 603 is increased by the speed change gear transmission 660, and is transmitted to the compression mechanism 610.

That is, a roller type one-way clutch 670 is provided between the rotor 632 of the electric motor unit 630 and the shaft 602. A pulley shaft 605 connected to the pulley 603 is connected to the shaft 602 through the speed change gear transmission 660. The rotational direction of the rotational driving force transmitted by the one-way clutch 670 corresponds to the orbiting direction of the movable scroll member 612. Thus, when the rotor 632 rotates in the orbiting direction of the movables scroll member 612, the rotational driving force thereof is always transmitted to the shaft 602.

Figure 12:
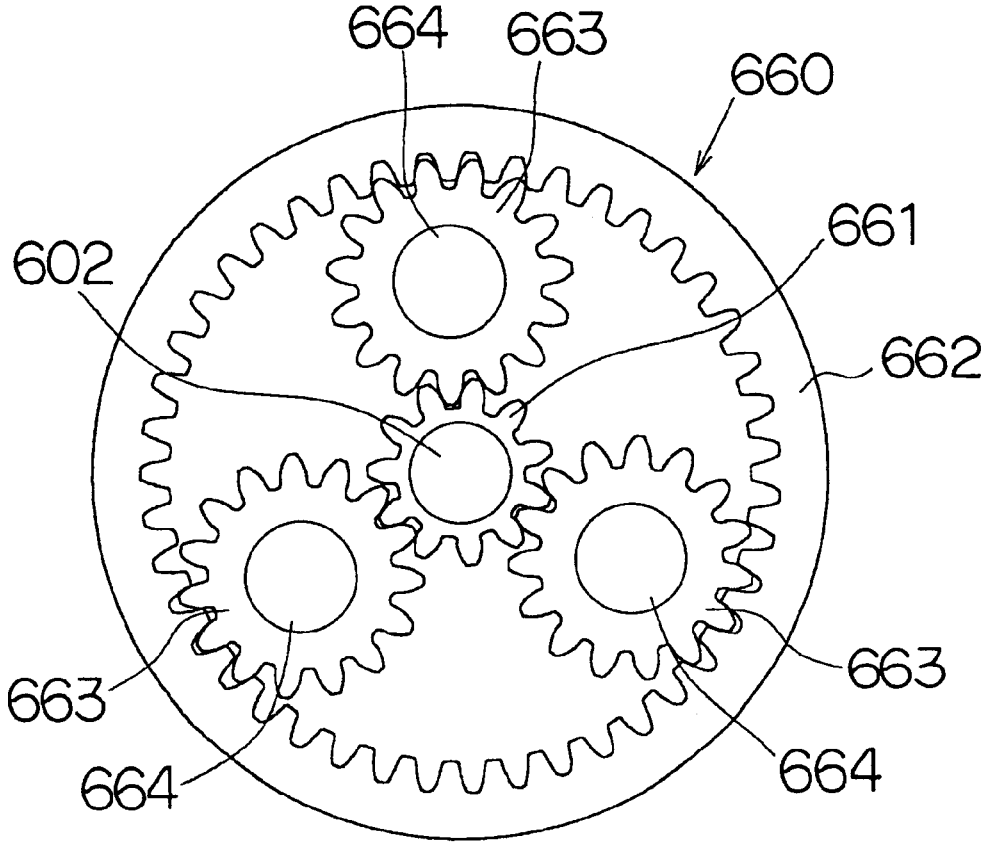
FIG. 12 is a plan view showing a speed change gear transmission according to the sixth embodiment.

In the present embodiment, the sun gear 661 rotates with the shaft 602, and the holder 664 rotates with the pulley shaft 605. The internal gear 662 is integrated with the front housing 604, and the planetary gear 663 is rotatably supported by the holder 664 (FIG. 12).

Next, an operation of the present embodiment will be described.

1. When the compression mechanism 610 is stopped:

The electric current is not supplied to the electromagnetic clutch 620 and the electric motor unit 630.

Thus, the rotational driving force is not transmitted from the engine to the shaft 602, and the electric motor unit 630 does not operate. Thereby, the compression mechanism 610 is stopped.

2. When the compression mechanism 610 is driven by the engine:

The electric current is supplied to the electromagnetic clutch 620, and is not supplied to the electric motor unit 630.

Then, the armature 622 engages with the rotor 623, however, the electric motor 630 is not operate. Therefore, the rotational driving force is transmitted from the engine to the shaft 602 through the speed change gear transmission 660, and the compression mechanism 610 is driven by the engine only.

3. When the compression mechanism 610 is driven by the electric motor unit 630:

The electric current is supplied to the electric motor unit 630, and is not supplied to the electromagnetic clutch 620.

Thus, the electric motor unit 630 operates, however the rotational driving force from the engine is not transmitted to the shaft 602. Therefore, the rotational driving force of the electric motor unit 630 is transmitted to the shaft 602 through the one-way clutch 670, and the compression mechanism 610 is driven by only the electric motor unit 630.

In the present sixth embodiment, the rotational speed of the engine is increased by the speed change gear transmission 670, and is transmitted to the shaft 602 (compression mechanism 610). Thus, the compression mechanism 610 can be driven with the discharge volume Vc being small and the rotational speed being high. As a result, the driving torque driving the compression mechanism 610 is made small, thereby downsizing the electric motor unit 630.

Further, because the rotational speed of the engine is increased by the speed change gear transmission 660, the pulley 603 does not need to be downsized. Therefore, the sufficient friction torque of the electromagnetic clutch 620, which transmits the rotational driving force to the shaft 602, is attained.

In the above fifth and sixth embodiment, the speed change gear transmissions 640, 660 are constructed by the planetary gear mechanism. However, the speed change gear transmission 640, 660 are not limited to this, other speed change gear units such as formed of gear trains may be employed.

(Seventh Embodiment)

According to a seventh embodiment, the rotational speed of the electric motor unit 630 is reduced and the rotational speed of the engine is increased by a single speed change gear transmission 680, and are transmitted to the compression mechanism 610.

Figure 13:
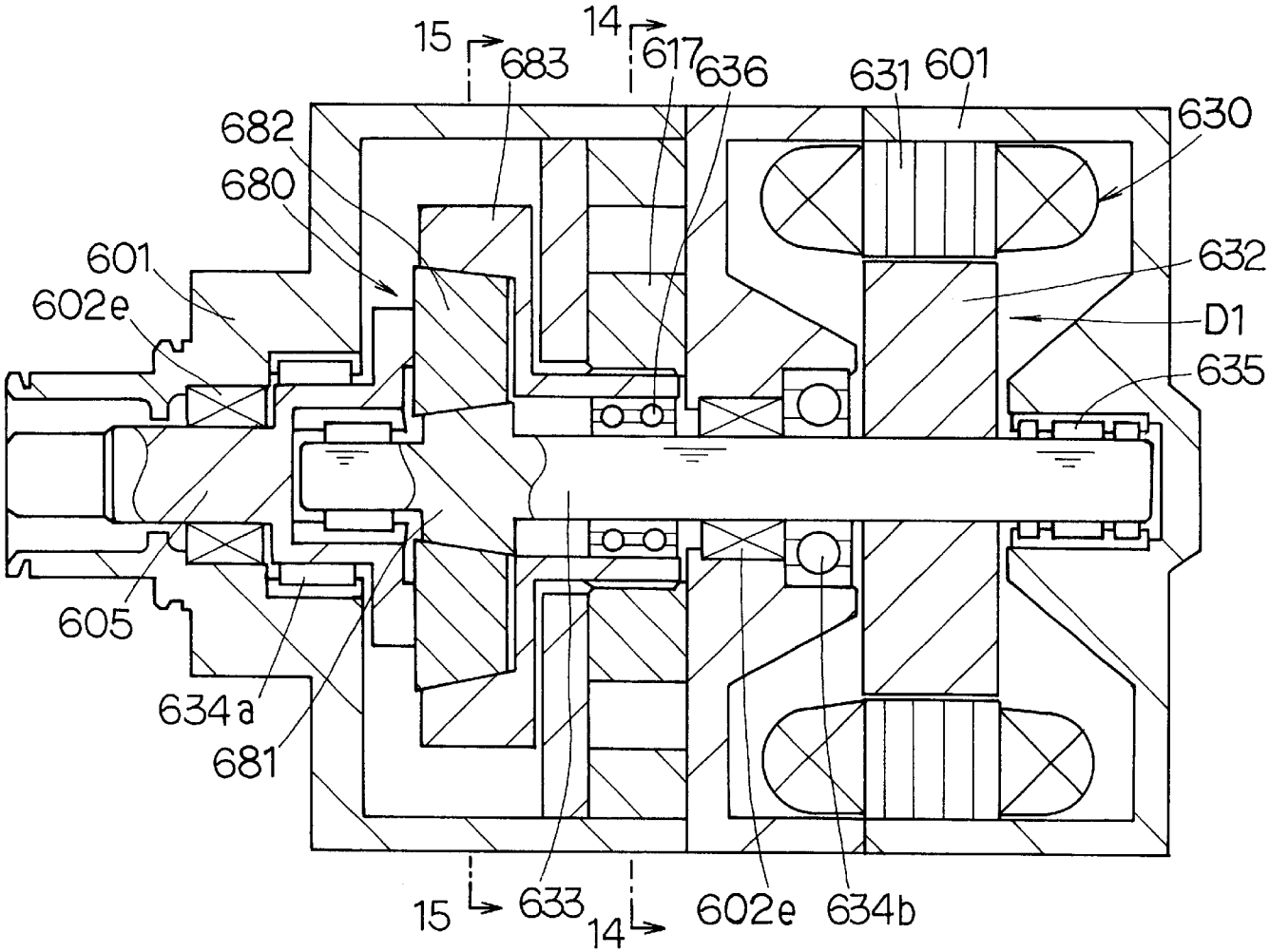
FIG. 13 is an entire cross sectional view showing a hybrid type compressor according to a seventh embodiment.
Figure 14:
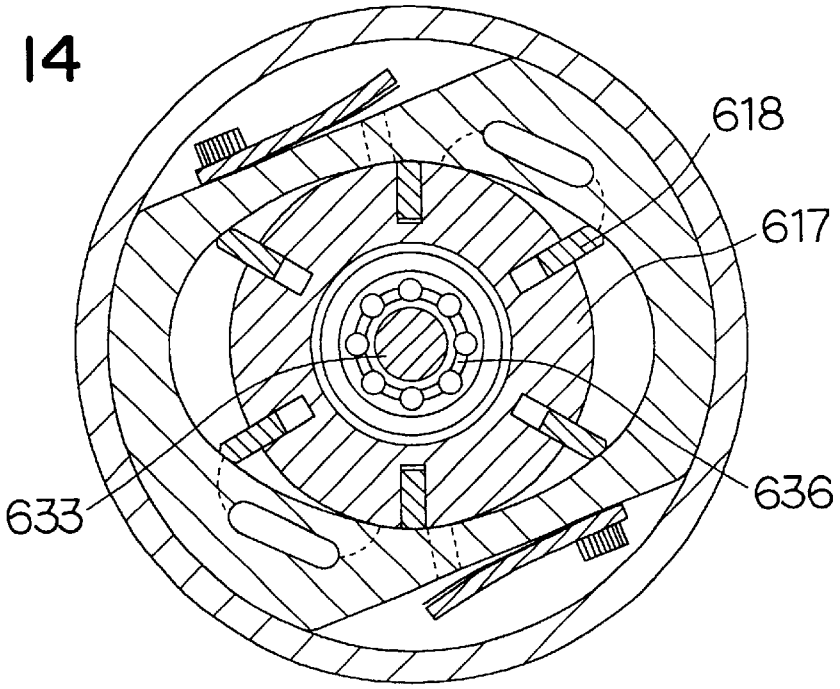
FIG. 14 is a cross sectional view taken along line 14—14 in FIG. 13.

That is, as shown in FIGS. 13, 14, a sun gear 681 is integrally formed on a motor shaft (rear shaft) 633, which rotates with the rotor 632, at the front side thereof, and planetary gears 682 engaging with the sun gear 681 and a ring gear 683 engaging with the planetary gears 682 are provided at the same position. In this way, a speed change gear transmission 680 is constructed by a planetary gear mechanism.

Each planetary gear 682 is fixed to the pulley shaft (front shaft) 605, and orbits around the sun gear 681 while self rotating in accordance with the rotation of the pulley shaft 605. The ring gear 683 is connected to the rotor 617 of the compression mechanism 610, and rotates with the rotor 617 integrally. Here, in the present embodiment, a vane type compression mechanism, which is constructed by the rotor 617 and plural vanes 618 protruding inwardly by a centrifugal force of the rotor 617, is employed as the compression mechanism 610.

A motor shaft 633 is rotatably supported by bearings 634*a*, 634*b*. A one-way clutch 635 is provided at the rear end of the compression mechanism 610 for allowing the motor shaft 633 to rotate in only one rotational direction, which is an opposite rotational direction of the pulley shaft 605. The ring gear 683 and the rotor 617 are supported by a bearing 636 rotatably with respect to the motor shaft 633. The pulley shaft 605 is supported by a bearing 605*a* rotatably with respect to the front housing 604.

Next, an operation of the present embodiment will be described.

1. When the compression mechanism 610 is stopped:

The electric current is not supplied to the electromagnetic clutch (not illustrated) and the electric motor unit 630.

Thus, the rotational driving force is not transmitted from the engine to the pulley shaft 605, and the electric motor unit

630 does not operate. Thereby, the compression mechanism 610 is stopped.

2. When the compression mechanism 610 is driven by the engine:

The electric current is supplied to the electromagnetic clutch, and is not supplied to the electric motor unit 630.

Figure 15:
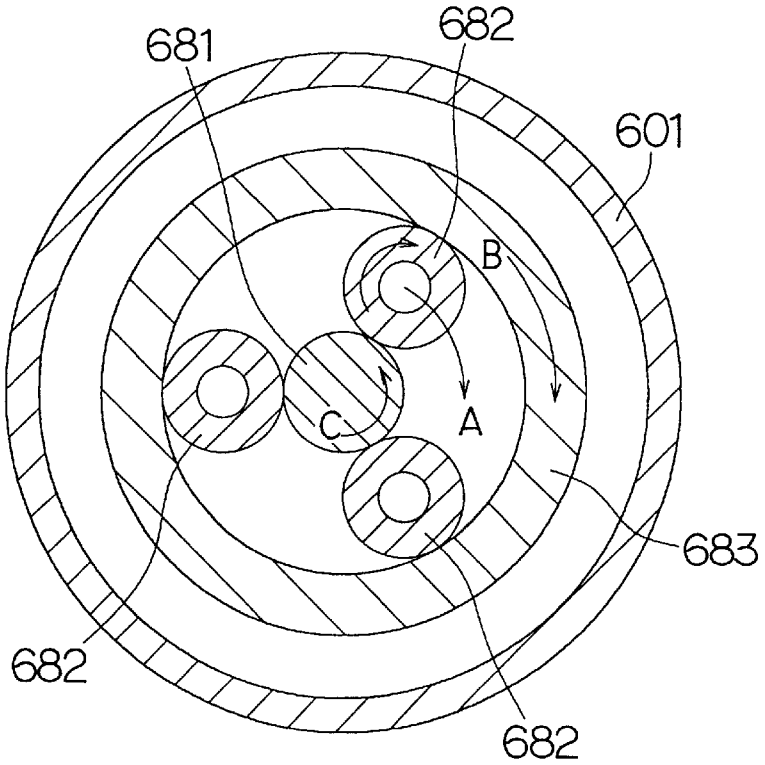
FIG. 15 is a cross sectional view taken along line 15—15 in FIG. 13.

Then, the armature engages with the rotor by the electromagnetic clutch, and the pulley shaft 605 rotates in an "A" direction in FIG. 15. At this time, because the motor shaft 633 does not rotate by being restricted by the one-way clutch 635, the rotational driving force is transmitted from the pulley shaft 605 to the ring gear 683 through the planetary gear 682. Therefore, the rotation of the pulley shaft 605 is speed-increased and transmitted to the compression mechanism 610 (rotor 617).

3. When the compression mechanism 610 is driven by the electric motor unit 630:

The electric current is supplied to the electric motor unit 630, and is not supplied to the electromagnetic clutch.

Thus, the motor shaft 633 rotates in a "C" direction in FIG. 15. At this time, because the pulley shaft 605 does not rotate, the planetary gear 682 does not orbit but self rotates. Thus, the rotational speed of the motor shaft 633 is reduced by the planetary gear 682 and transmitted to the ring gear 683 (rotor 617), and the compression mechanism 610 is driven.

In the present embodiment, the rotational speed of the engine is increased and transmitted to the compression mechanism 610, thereby downsizing the electric motor unit 630.

Further, because the rotational speed of the electric motor unit 630 is reduced, i.e., the rotational driving force of the electric motor unit 630 is increased, and is transmitted to the compression mechanism 610, the electric motor unit 630 can be is downsized.

As a result, both first driving portion D1 and second driving portion D2 in the fifth and sixth embodiments are downsized, thus the hybrid type compressor is entirely further downsized.

In the above-described fifth through seventh embodiments, the electromagnetic clutch 620 is employed as the clutch mechanism, however, the clutch mechanism is not limited to this. For example, other clutch mechanisms in which the clutch plate is pressed by the discharge pressure of the compression mechanism 610 may be employed.

The one-way clutches 650, 670 are not limited to the roller type one-way clutch, and a sprag type one-way clutch may be employed.

In the above fifth through seventh embodiment, the scroll type or vane type compression mechanisms are employed, however, other compression mechanisms such as a swash plate type compression mechanism may be employed.

What is claimed is:

1. A hybrid type compressor driven by an electric motor and an external driving source, comprising:

a housing;

a compression mechanism provided in said housing for suctioning and compressing a fluid, said compression mechanism including a fixed member fixed to said housing and movable member moving with respect to said fixed member;

a shaft rotatably supported in said housing for transmitting rotational driving force to said movable member;

an electric motor unit for generating rotational driving force for rotating said shaft, said electric motor unit including a stator fixed to said housing and rotor rotating within said stator;

a clutch mechanism for transmitting rotational driving force of said external driving source to said shaft;

a one-way clutch for allowing the rotational driving force generated by said electric motor unit to be transmitted only from said rotor to said shaft, and a speed changing mechanism for decreasing a speed of rotation generated by said electric motor unit and transmitting the rotational driving force to said shaft.

2. A hybrid type compressor according to claim 1, wherein said clutch mechanism is an electromagnetic clutch provided outside said housing.

* * * * *